US005165008A

United States Patent [19]

Hermansky et al.

[11] Patent Number: 5,165,008

[45] Date of Patent: Nov. 17, 1992

[54] SPEECH SYNTHESIS USING PERCEPTUAL LINEAR PREDICTION PARAMETERS

[75] Inventors: Hynek Hermansky; Louis A. Cox, Jr., both of Denver, Colo.

[73] Assignee: U S West Advanced Technologies, Inc., Boulder, Colo.

[21] Appl. No.: 761,190

[22] Filed: Sep. 18, 1991

[51] Int. Cl.[5] ..... G10L 5/02; G10L 9/10; G10L 5/00

[52] U.S. Cl. ..... 395/2; 381/51; 381/53; 381/36

[58] Field of Search ..... 387/36-39, 387/49-51, 53; 395/2

[56] References Cited

U.S. PATENT DOCUMENTS

| | | | |
|---|---|---|---|
| 4,051,331 | 9/1977 | Strong et al. | 381/50 |
| 4,130,730 | 12/1978 | Ostrowski | 381/53 |
| 4,763,278 | 8/1988 | Rajasekaran et al. | 395/2 |
| 4,829,573 | 5/1989 | Gagnon et al. | 381/36 |
| 4,882,758 | 11/1989 | Uekawa et al. | 381/50 |
| 4,908,865 | 3/1990 | Doddington et al. | 395/2 |
| 4,914,702 | 4/1990 | Taguchi | 381/39 |

OTHER PUBLICATIONS

"Linear Prediction: A Tutorial Review" by John Makhoul, Reprinted from Proc of IEEE vol. 63 Apr. 1975, May 17, 1988.

"Linear Prediction with a Variable Analysis Frame Size" by Chandra et al., IEEE Trans on ASSP Aug. 1977.

Broad, David J., et al., *Formant Estimation by Linear Transformation of the LPC Cepstrum,* Reprinted from The Journal of the Acoustical Society of America, vol. 86, No. 5, Nov. 1989, pp. 2013-2017.

Hermansky, H., *Perceptual Linear Predictive (PLP) Analysis of Speech,* J. Acoust. Soc. Am. 87(4), Apr. 1990, copyright 1990, Acoustical Society of America, pp. 1738-1752.

Hermansky, H., et al., *The Effective Second Formant F2' and the Vocal Tract Front-Cavity,* ICASSP-89, Glasgow, Scotland, CH2673-Feb. 1989, copyright 1989 IEEE, pp. 480-483.

*Primary Examiner*—Dale M. Shaw
*Assistant Examiner*—Kee M. Tung
*Attorney, Agent, or Firm*—Timothy R. Schulte

[57] ABSTRACT

A method for synthesizing human speech using a linear mapping of a small set of coefficients that are speaker-independent. Preferably, the speaker-independent set of coefficients are cepstral coefficients developed during a training session using a perceptual linear predictive analysis. A linear predictive all-pole model is used to develop corresponding formants and bandwidths to which the cepstral coefficients are mapped by using a separate multiple regression model for each of the five formant frequencies and five formant bandwidths. The dual analysis produces both the cepstral coefficients of the PLP model for the different vowel-like sounds and their true formant frequencies and bandwidths. The separate multiple regression models developed by mapping the cepstral coefficients into the formant frequencies and formant bandwidths can then be applied to cepstral coefficients determined for subsequent speech to produce corresponding formants and bandwidths used to synthesize that speech. Since less data are required for synthesizing each speech segment than in conventional techniques, a reduction in the required storage space and/or transmission rate for the data required in the speech synthesis is achieved. In addition, the cepstral coefficients for each speech segment can be used with the regressive model for a different speaker, to produce synthesized speech corresponding to the different speaker.

20 Claims, 11 Drawing Sheets

SPEECH SYNTHESIS USING PERCEPTUAL LINEAR PREDICTION PARAMETERS

FIELD OF THE INVENTION

This invention generally pertains to speech synthesis, and particularly, speech synthesis from parameters that represent short segments of speech with multiple coefficients and weighting factors.

BACKGROUND OF THE INVENTION

Speech can be synthesized using a number of very different approaches. For example, digitized recordings of words can be reassembled into sentences to produce a synthetic utterance of a telephone number. Alternatively, a phonetic representation of the telephone number can be produced using phonemes for each sound comprising the utterance. Perhaps the dominant technique used in speech synthesis is linear predictive coding (LPC), which describes short segments of speech using parameters that can be transformed into positions (frequencies) and shapes (bandwidths) of peaks in the spectral envelope of the speech segments. In a typical 10th order LPC model, ten such parameters are determined, the frequency peaks defined thereby corresponding to resonant frequencies of the speaker's vocal tract. The parameters defining each segment of speech (typically, 10–20 milliseconds per segment) represent data that can be applied to conventional synthesizer hardware to replicate the sound of the speaker producing the utterance.

It can be shown that for a given speaker, the shape of the front cavity of the vocal tract is the primary source of linguistic information. The LPC model includes substantial information that remains approximately constant from segment to segment of an utterance by a given speaker (e.g., information reflecting the length of the speaker's vocal chords). As a consequence, the data representing each segment of speech in the LPC model include considerable redundancy, which creates an undesirable overhead for both storage and transmission of that data.

It is desirable to use the smallest number of parameters required to represent a speech segment for synthesis, so that the requirements for storing such data and the bit rate for transmitting the data can be reduced. Accordingly, it is desirable to separate the speaker-independent linguistic information from the superfluous speaker-dependent information. Since the speaker-independent information that varies with each segment of speech conveys the data necessary to synthesize the words embodied in an utterance, considerable storage space can potentially be saved by separately storing and transmitting the speaker-dependent information for a given speaker, separate from the speaker-independent information. Many such utterances could be stored or transmitted in terms of their speaker-independent information and then synthesized into speech by combination with the speaker-dependent information, thereby greatly reducing storage media requirements and making more channels in an assigned bandwidth available for transmittal of voice communications using this technique. Furthermore, different speaker-dependent information could be combined with the speaker-independent information to synthesize words spoken in the voice of another speaker, for example, by substituting the voice of a female for that of a male or the voice of a specific person for that of the speaker. By reducing the amount of data required to synthesize speech, data storage space and the quantity of data that must be transmitted to a remote site in order to synthesize a given vocalization are greatly reduced. These and other advantages of the present invention will be apparent from the drawings and from the Detailed Description of the Preferred Embodiment that follows.

SUMMARY OF THE INVENTION

In accordance with the present invention, a method for synthesizing human speech comprises the steps of determining a set of coefficients defining an auditory-like, speaker-independent spectrum of a given human vocalization, and mapping the set of coefficients to a vector in a vocal tract resonant vector space. Using this vector, a synthesized speech signal is produced that simulates the linguistic content (the string of words) in the given human vocalization. Substantially fewer coefficients are required than the number of vector elements produced (the dimension of the vector). These coefficients comprise data that can be stored for later use in synthesizing speech or can be transmitted to a remote location for use in synthesizing speech at the remote location.

The method further comprises the steps of determining speaker-dependent variables that define qualities of the given human vocalization specific to a particular speaker. The speaker-dependent variables are then used in mapping the coefficients to produce the vector of the vocal resonant tract space, to effect a simulation of that speaker uttering the given vocalization. Furthermore, the speaker-dependent variables remain substantially constant and are used with successive different human vocalizations to produce a simulation of the speaker uttering the successive different vocalizations.

Preferably, the coefficients represent a second formant, F2′, corresponding to a speaker's mouth cavity shape during production of the given vocalization. The step of mapping comprises the step of determining a weighting factor for each coefficient so as to minimize a mean squared error of each element of the vector in the vocal tract resonant space (preferably determined by multivariate least squares regression). Each element is preferably defined by:

$$e_1 = a_{i0} + \sum_{j=1}^{N} a_{ij}C_{ij}$$

where $e_i$ is the i-th element, $a_{i0}$ is a constant portion of that element, $a_{ij}$ is a weighting factor associated with a j-th coefficient for the i-th element, $c_{ij}$ is the j-th coefficient for the i-th element; and N is the number of coefficients.

DETAILED DESCRIPTION OF THE PREFERRED EMBODIMENT

Figure 1:
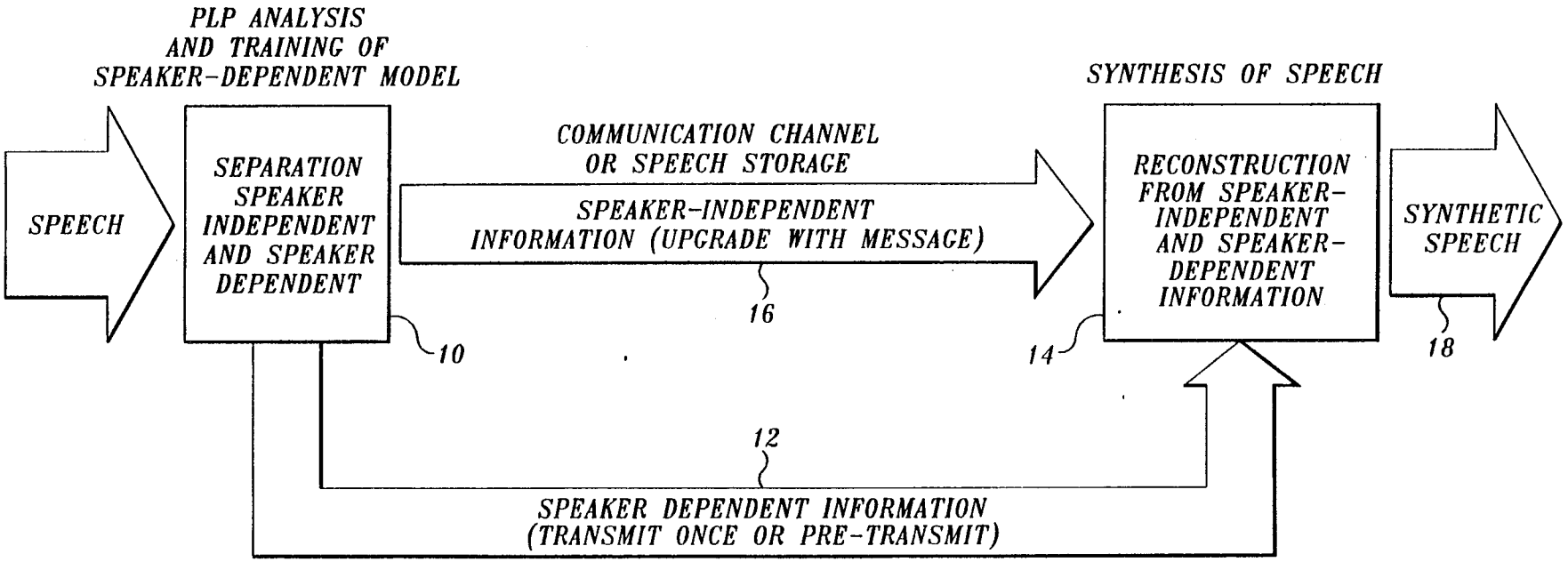
FIG. 1 is a schematic block diagram illustrating the principles employed in the present invention for synthesizing speech.

The principles employed in synthesizing speech according to the present invention are generally illustrated in FIG. 1. The process starts in a block 10 with the PLP analysis of selected speech segments that are used to "train" the system, producing a speaker-dependent model. (See the article, "Perceptual Linear Predictive (PLP) Analysis of Speech", by Hynek Hermansky, Journal of the Acoustical Society of America, Vol 87, pp 1738–1752 April 1990.) This speaker-dependent model is represented by data that are then transmitted in real time (or pre-transmitted and stored) over a link 12 to another location, indicated by a block 14. The transmission of this speaker-dependent model may have occurred sometime in the past or may immediately precede the next phase of the process, which involves the PLP analysis of current speech, separating its substantially constant speaker-dependent content from its varying speaker-independent content. The speaker-independent content of the speech that is processed after the training phase is transmitted over a link 16 to block 14, where the speech is reconstructed or synthesized from the speaker-dependent information, at a block 18. If a different speaker-dependent model, for example, speaker-dependent model for a female, is applied to speaker-independent information produced from the speech (of a male) during the process of synthesizing speech, the reconstructed speech will sound like the female from whom the speaker-dependent model was derived. Since the speaker-independent information for a given vocalization requires only about one-half the number of data points of the conventional LPC model typically used to synthesize speech, storage and transmission of the speaker-independent data are substantially more efficient. The speaker-dependent data can potentially be updated as rarely as once each session, i.e., once each time that a different speaker-dependent model is required to synthesize speech (although less frequent updates may produce a deterioration in the nonlinguistic parts of the synthesized speech).

Figure 2:
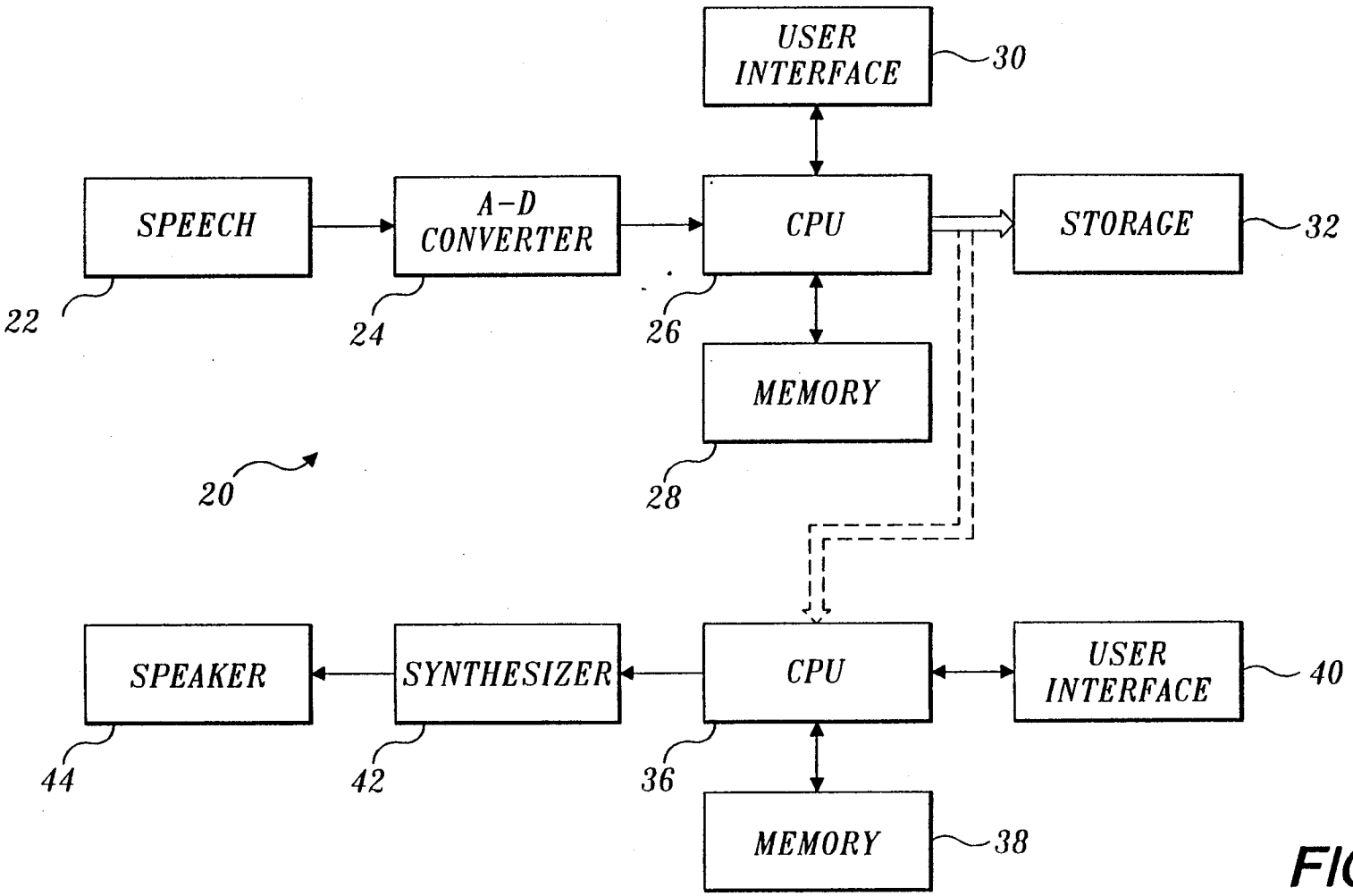
FIG. 2 is a block diagram of apparatus for analyzing and synthesizing speech in accordance with the present invention.

Apparatus for synthesizing speech in accordance with the present invention are shown generally in FIG. 2 at reference numeral 20. A block 22 represents either speech uttered in real time or a recorded vocalization. Thus, a person speaking into a microphone may produce the speech indicated in block 22, or alternatively, the words spoken by the speaker may be stored on semi-permanent media, such as on magnetic tape. Whether produced by a microphone or by playback from a storage device (neither shown), the analog signal produced is applied to an analog-to-digital (A-D) converter 24, which changes the analog signal representing human speech to a digital format. Analog-to-digital converter 24 may comprise any suitable commercial integrated circuit A-D converter capable of providing eight or more bits of digital resolution through rapid conversion of an analog signal.

A digital signal produced by A-D converter 24 is fed to an input port of a central processor unit (CPU) 26. CPU 26 is programmed to carry out the steps of the present method, which include the both the initial training session and analysis of subsequent speech from block 22, as described in greater detail below. The program that controls CPU 26 is stored in a memory 28, comprising, for example, a magnetic media hard drive or read only memory (ROM), neither of which is separately shown. Also included in memory 28 is random access memory (RAM) for temporarily storing variables and other data used in the training and analysis. A user interface 30, comprising a keyboard and display, is connected to CPU 26, allowing user interaction and monitoring of the steps implemented in processing the speech from block 22.

Data produced during the initial training session through analysis of speech are converted to a digital format and stored in a storage device 32, comprising a hard drive, floppy disk, or other nonvolatile storage media. For subsequently processing speech that is to be synthesized, CPU 26 carries out a perceptual linear predictive (PLP) analysis of the speech to determine several cepstral coefficients, $C_1 \ldots C_n$ that comprise the speaker-independent data. In the preferred embodiment, only five cepstral coefficients are required for each segment of the speaker-independent data used to synthesize speech (and in "training" the speaker-dependent model).

In addition, CPU 26 is programmed to perform a formant analysis, which is used to determine a plurality of formants $F_1$ through $F_n$ and corresponding bandwidths $B_1$ through $B_n$. The formant analysis produces data used in formulating a speaker-dependent model. The formant and bandwidth data for a given segment of speech differ from one speaker to another, depending upon the shape of the vocal tract and various other speaker-dependent physiological parameters. During the training phase of the process, CPU 26 derives multiple regressive speaker-dependent mappings of the cepstral coefficients of the speech segments spoken during the training exercise, to the corresponding formants and bandwidths $F_i$ and $B_i$ for each segment of speech. The speaker-dependent model resulting from mapping the cepstral coefficients to the formants and bandwidths for each segment of speech is stored in storage device 32 for later use.

Alternatively, instead of storing this speaker-dependent model, the data comprising the model can be transmitted to a remote CPU 36, either prior to the need to synthesize speech, or in real time. Once remote CPU 36 has stored the speaker-dependent model required to map between the speaker-independent cepstral coefficients and the formants and bandwidths representing the speech of a particular speaker, it can apply the model data to subsequently transmitted cepstral coefficients to reproduce any speech of that same speaker.

The speaker-dependent model data are applied to the speaker-independent cepstral coefficients for each segment of speech that is transmitted from CPU 26 to CPU 36 to reproduce the synthesized speech, by mapping the cepstral coefficients to corresponding formants and bandwidths that are used to drive a synthesizer 42. A user interface 40 is connected to remote CPU 36 and preferably includes a keyboard and display for entering instructions that control the synthesis process and a display for monitoring its progression. Synthesizer 42 preferably comprises a Klsyn88 TM cascade/parallel formant synthesizer, which is a combination software and hardware package available from Sensimetrics Corporation, Cambridge, Mass. However, virtually any synthesizer suitable for synthesizing human speech from LPC formant and bandwidth data can be used for this purpose. Synthesizer 42 drives a conventional loudspeaker 44 to produce the synthesized speech. Loudspeaker 44 may alternatively comprise a telephone receiver or may be replaced by a recording device to record the synthesized speech.

Remote CPU 36 can also be controlled to apply a speaker-dependent model mapping for a different speaker to the speaker-independent cepstral coefficients transmitted from CPU 26, so that the speech of one speaker is synthesized to sound like that of a different speaker. For example, speaker-dependent model data for a female speaker can be applied to the transmitted cepstral coefficients for each segment of speech from a male speaker, causing synthesizer 42 to produce synthesized speech, which on loudspeaker 44, sounds like a female speaker speaking the words originally uttered by the male speaker. CPU 36 can also modify the speaker-dependent model in other ways to enhance, or otherwise change the sound of the synthesized speech produced by loudspeaker 44.

One of the primary advantages of the technique implemented by the apparatus in FIG. 1 is the reduced quantity of data that must be stored and/or transmitted to synthesize speech. Only the speaker-dependent model data and the cepstral coefficients for each successive segment of speech must be stored or transmitted to synthesize speech, thereby reducing the number of bytes of data that need be stored by storage device 32, or transmitted to remote CPU 36.

Figure 3:
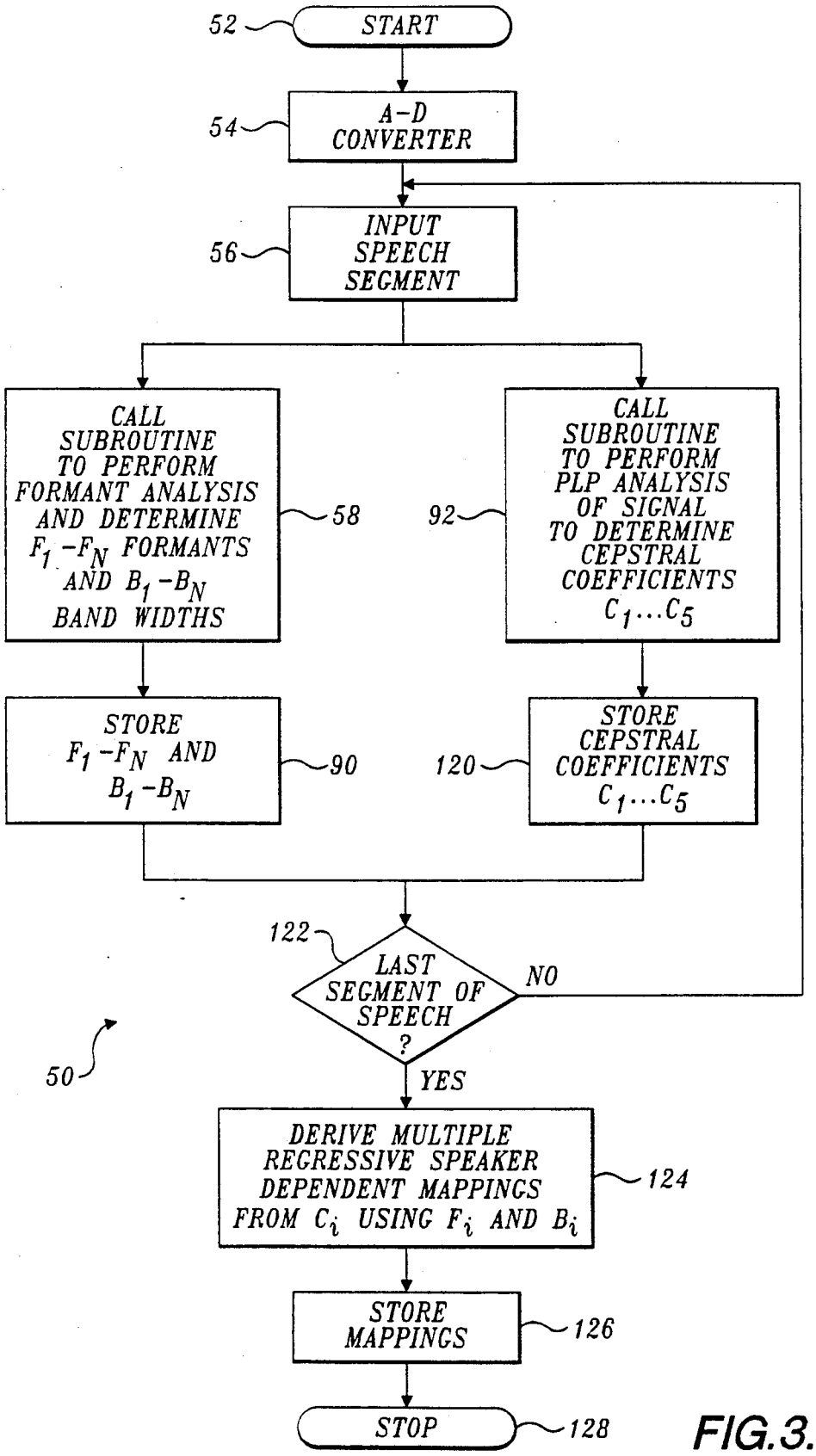
FIG. 3 is a flow chart illustrating the steps implemented in analyzing speech to determine its characteristic formants, associated bandwidths, and cepstral coefficients.

As noted above, the training steps implemented by CPU 26 initially determine the mapping of cepstral coefficients for each segment of speech to their corresponding formants and bandwidths to define how subsequent speaker-independent cepstral coefficients should be mapped to produce synthesized speech. In FIG. 3, a flow chart 50 shows the steps implemented by CPU 26 in this training procedure and the steps later used to derive the speaker-independent cepstral coefficients for synthesizing speech. Flow chart 50 starts at a block 52. In a block 54, the analog values of the speech are digitized for input to a block 56. In block 56, a predefined time interval of approximately 20 milliseconds in the preferred embodiment defines a single segment of speech that is analyzed according to the following steps. Two procedures are performed on each digitized segment of speech, as indicated in flow chart 50 by the parallel branches to which block 56 connects.

Figure 5:
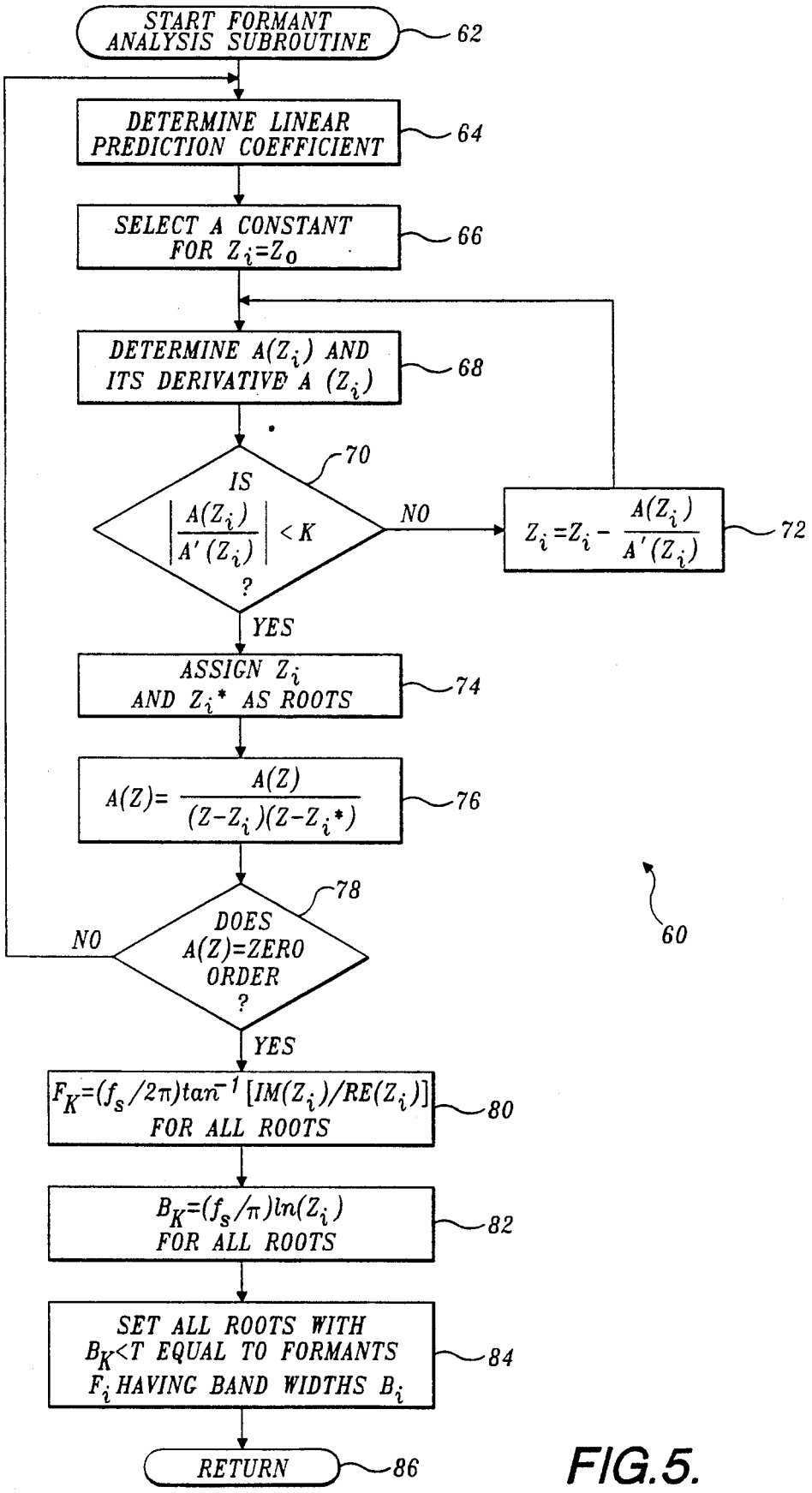
FIG. 5 is flow chart showing the steps of a subroutine for analyzing formants.

In a block 58, a subroutine is called that performs formant analysis to determine the $F_1$ through $F_n$ formants and their corresponding bandwidths, $B_1$ through $B_n$ for each segment of speech processed. The details of the subroutine used to perform the formant analysis are shown in FIG. 5 in a flow chart 60. Flow chart 60 begins at a block 62 and proceeds to a block 64, wherein CPU 26 determines the linear prediction coefficients for the current segment of speech being processed. Linear predictive analysis of digital speech signals is well known in the art. For example, J. Makhoul described the technique in a paper entitled "Spectral Linear Prediction: Properties and Applications," IEEE Transaction ASSP-23, 1975, pp. 283–296. Similarly, in U.S. Pat. No. 4,882,758 (Uekawa et al.), an improved method for extracting formant frequencies is disclosed and compared to the more conventional linear predictive analysis method.

In block 64, CPU 26 processes the digital speech segment by applying a pre-emphasis and then using a window with an autocorrelation calculation to obtain linear prediction coefficients by the Durbin method. The Durbin method is also well known in the art, and is described by L. R. Rabiner and R. W. Schafer in *Digital Processing of Speech Signals*, a Prentice-Hall publication, pp. 411–413.

In a block 66, a constant $Z_0$ is selected for an initial value as a root $Z_i$. In a block 68, CPU 26 determines a value of A(z) from the following equation:

$$A(Z) = \sum_{k=0}^{P} a_k \cdot Z^{-k} \; (a_0 = 1) \tag{1}$$

where $a_k$ are linear prediction coefficients. In addition, the CPU determines the derivative $A'(Z_i)$ of this function. A decision block 70 then determines if the absolute value of $A(Z_i)/A'(Z_i)$ is less than a specified tolerance threshold value K. If not, a block 72 assigns a new value to $Z_i$, as shown therein. The flow chart then returns to block 68 for redetermination of a new value for the function $A(Z_i)$ and its derivative. As this iterative loop continues, it eventually reaches a point where an affirmative result from decision block 70 leads to a block 74, which assigns $Z_i$ and its complex conjugate $Z_i^*$ as roots of the function A(z). A block 76 then divides the function A(z) by the quadratic expression of $Z_i$ and its complex conjugate, as shown therein.

A decision block 78 determines whether $Z_i$ is a zero-order root of the function A(Z) and if not, loops back to block 64 to repeat the process until a zero order value for the function A(Z) is obtained. Once an affirmative result from decision block 78 occurs, a block 80 determines the corresponding formants $F_k$ for all roots of the equation as defined by:

$$F_k = (f_8/2\pi)\tan^{-1}[Im(Z_i)/Re(Z_i)] \tag{2}$$

Similarly, a block 82 defines the bandwidth corresponding to the formants for all the roots of the function as follows:

$$B_k=(f_s/\pi)1n|Z_1| \quad (3).$$

A block 84 then sets all roots with $B_k$ less than a constant threshold T equal to formants $F_i$ having corresponding bandwidths $B_i$. A block 86 then returns from the subroutine to the main program implemented in flow chart 50.

Following a return from the subroutine called in block 58 of FIG. 3, a block 90 stores the formants $F_1$ through $F_N$ and corresponding bandwidths $B_1$ through $B_N$ in memory 28 (FIG. 2).

Figure 6:
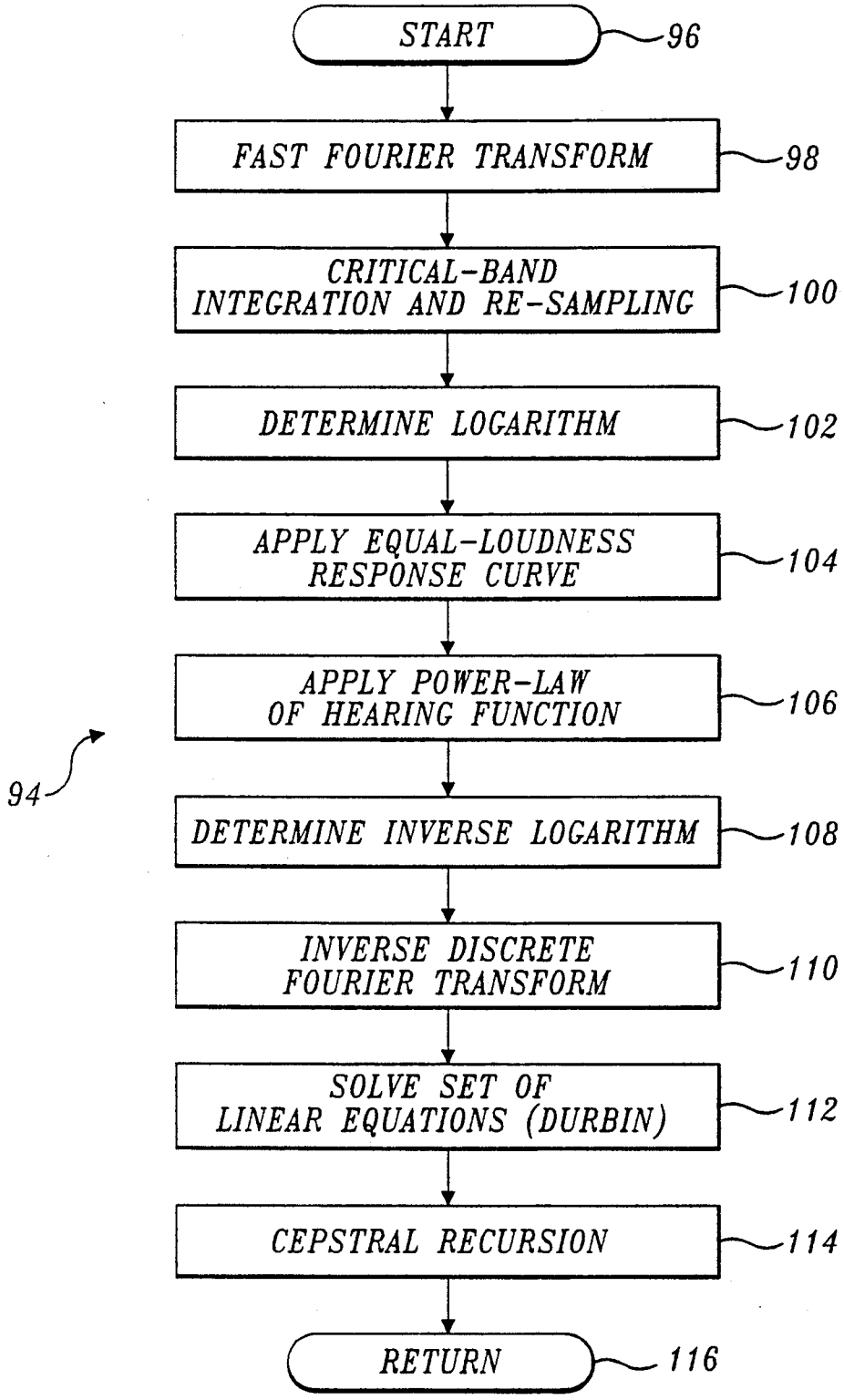
FIG. 6 is a flow chart illustrating the subroutine steps required to perform a perceptive linear predictive (PLP) analysis of speech, to determine the cepstral coefficients.

The other branch of flow chart 50 following block 56 in FIG. 3 leads to a block 92 that calls a subroutine to perform PLP analysis of the digitized speech segment to determine its corresponding cepstral coefficients. The subroutine called by block 92 is illustrated in FIG. 6 by a flow chart 94.

Flow chart 94 begins at a block 96 and proceeds to a block 98, which performs a fast Fourier transform of the digitized speech segment. In carrying out the fast Fourier transform, each speech segment is weighted by a Hamming window, which is a finite duration window represented by the following equation:

$$W(n)=0.54+0.46\cos[2\pi n/(T-1)] \quad (4)$$

where T, the duration of the window, is typically about 20 milliseconds. The Fourier transform performed in block 98 transforms the speech segment weighted by the Hamming window into the frequency domain. In this step, the real and imaginary components of the resulting speech spectrum are squared and added together, producing a short-term power spectrum $P(\omega)$, which can be represented as follows:

$$P(\omega)=Re[S(\omega)]^2+Im[S(\omega)]^2 \quad (5).$$

Typically, for a 10 KHz sampling frequency, a 256-point fast Fourier transform is applied to transform 200 speech samples (from the 20-millisecond window that was applied to obtain the segment), with the remaining 56 points padded by zero-valued samples.

In a block 100, critical band integration and resampling is performed, during which the short-term power spectrum $P(\omega)$ is warped along its frequency access $\omega$ into the Bark frequency $\Omega$ as follows:

$$\Omega(\omega) = 6\ln\left\{\frac{\omega}{1200\pi}+\left[\left(\frac{\omega}{1200\pi}\right)^2+1\right]^{0.5}\right\} \quad (6)$$

wherein $\omega$ is the angular frequency in radians per second, resulting in a Bark-Hz transformation. The resulting warped power spectrum is then convolved with the power spectrum of the simulated critical band masking curve $\psi(\omega)$. Except for the particular shape of the critical-band curve, this step is similar to spectral processing in mel cepstral analysis. The critical band curve is defined as follows:

$$\psi(\Omega) = \begin{cases} 0 & \text{for } \Omega < -1.3 \\ 10^{2.5(\Omega+0.5)} & \text{for } -1.3 < \Omega < -0.5 \\ 1 & \text{for } -1.5 < \Omega < 0.5 \\ 10^{-1.0(\Omega-0.5)} & \text{for } 0.5 < \Omega < 2.5 \\ 0 & \text{for } \Omega > 2.5 \end{cases} \quad (7)$$

The piece-wise shape of the simulated critical-band masking curve is an approximation to an asymmetric masking curve. The intent of this step is to provide an approximation (although somewhat crude) of an auditory filter based on the proposition that the shape of auditory filters is approximately constant on the Bark scale and that the filter skirts are generally truncated at −40dB.

Convolution of $\psi(\omega)$ with (the even symmetric and periodic function) $P(\omega)$ yields samples of the critical-band power spectrum:

$$\Theta(\Omega_i) = \sum_{\Omega=-1.3}^{2.5} P(\Omega - \Omega_i)\psi(\Omega) \quad (8)$$

This convolution significantly reduces the spectral resolution of $\theta(\Omega)$ in comparison with the original $P(\omega)$, allowing for the down-sampling of $\theta(\Omega)$. In the preferred embodiment, $\theta(\Omega)$ is sampled at approximately one-Bark intervals. The exact value of the sampling interval is chosen so that an integral number of spectral samples covers the entire analysis band. Typically, for a bandwidth of 5 KHz, corresponding to 16.9-Bark, 18 spectral samples of $\theta(\Omega)$ are used, providing 0.994-Bark steps.

In a block 102, a logarithm of the computed critical-band spectrum is performed, and any convolutive constants appear as additive constants in the logarithm.

A block 104 applies an equal-loudness response curve to pre-emphasize each of the segments, where the equal-loudness curve is represented as follows:

$$\Xi[\Omega(\omega)]=E(\omega)\theta[\Omega(\omega)] \quad (9).$$

In this equation, the function $E(\omega)$ is an approximation to the human sensitivity to sounds at different frequencies and simulates the unequal sensitivity of hearing at about the 40dB level. Under these conditions, this function is defined as follows:

$$E(\omega) = \frac{(\omega^2 + 56.8 \times 10^6)\omega^4}{(\omega^2 + 6.3 \times 10^6)^2 (\omega^2 + 0.38 \times 10^9)} \quad (10)$$

The curve approximates a transfer function for a filter having asymptotes of 12dB per octave between 0 and 400 Hz, 0 dB per octave between 400 Hz and 1,200 Hz, 6 dB per octave between 1,200 Hz and 3,100 Hz, and zero dB per octave between 3,100 Hz and the Nyquist frequency (10 KHz in the preferred embodiment). In applications requiring a higher Nyquist frequency, an additional term can be added to the preceding expression. The values of the first (zero-Bark) and the last samples are made equal to the values of their nearest neighbors to ensure that the function resulting from the application of the equal loudness response curve begins and ends with two equal-valued samples.

In a block 106, a power-law of hearing function approximation is performed, which involves a cubic-root amplitude compression of the spectrum, defined as follows:

$$\Phi(\Omega)=\Xi(\Omega)^{0.33} \quad (11).$$

This compression is an approximation that simulates the nonlinear relation between the intensity of sound and its perceived loudness. In combination, the equal-loudness pre-emphasis of block 104 and the power law of hearing function applied in block 106 reduce the spectral-amplitude variation of the critical-band spectrum to produce a relatively low model order.

A block 108 provides for determining an inverse logarithm (i.e., determines an exponential function) of the compressed log critical-band spectrum. The resulting function approximates a relatively auditory spectrum.

A block 110 determines an inverse discrete Fourier transform of the auditory spectrum $\Phi(\Omega)$. Preferably, a 34-point inverse discrete Fourier transform is used. The inverse discrete Fourier transform is a better choice than the fast Fourier transform in this case, because only a few autocorrelation values are required in the subsequent analysis.

In linear predictive analysis, a set of coefficients that will minimize a mean-squared prediction error over a short segment of speech waveform is determined. One way to determine such a set of coefficients is referred to as the autocorrelation method of linear prediction. This approach provides a set of linear equations that relate autocorrelation coefficients of the signal representing the processed speech segment with the prediction coefficients of the autoregressive model. The resulting set of equations can be efficiently solved to yield the predictor parameters. The inverse Fourier transform of a nonnegative spectrum-like function resulting from the preceding steps can be interpreted as the autocorrelation function, and an appropriate autoregressive model of such a spectrum can be found. In the preferred embodiment of the present method, the equations for carrying out this solution apply Durbin's recursive procedure, as indicated in a block 112. This procedure is relatively efficient for solving specific linear equations of the autoregressive process.

Finally, in a block 114, a recursive computation is applied to determine the cepstral coefficients from the autoregressive coefficients of the resulting all-pole model.

If the overall LPC system has a transfer function H(z) with an impulse response h(n) and a complex cepstrum $\hat{h}(n)$, then $\hat{h}(n)$ can be obtained from the recursion:

$$\hat{h}(n) = a_n + \sum_{k=1}^{n-1}\left(\frac{k}{n}\right)\hat{h}(k)a_{n-k} \quad 1 \leq n \quad (12)$$

where $$H(z) = \sum_{n=0}^{\infty} h(n)z^{-n} = \frac{G}{1-\sum_{k=1}^{P} a_k z^{-k}} \quad (13)$$

(as shown by L. R. Rabiner and R. W. Schafer in *Digital Processing of Speech Signals*, a Prentice-Hall publication, page 442.) The complex cepstrum cited in this reference is equivalent to the cepstral coefficients $C_1$ through $C_5$.

After block 114 produces the cepstral coefficients, a block 116 returns to flow chart 50 in FIG. 3. Thereafter, a block 120 provides for storing the cepstral coefficients $C_1$ through $C_5$ in nonvolatile memory. Following blocks 90 or 120, a decision block 122 determines if the last segment of speech has been processed, and if not, returns to block 56 in FIG. 3.

Figure 7:
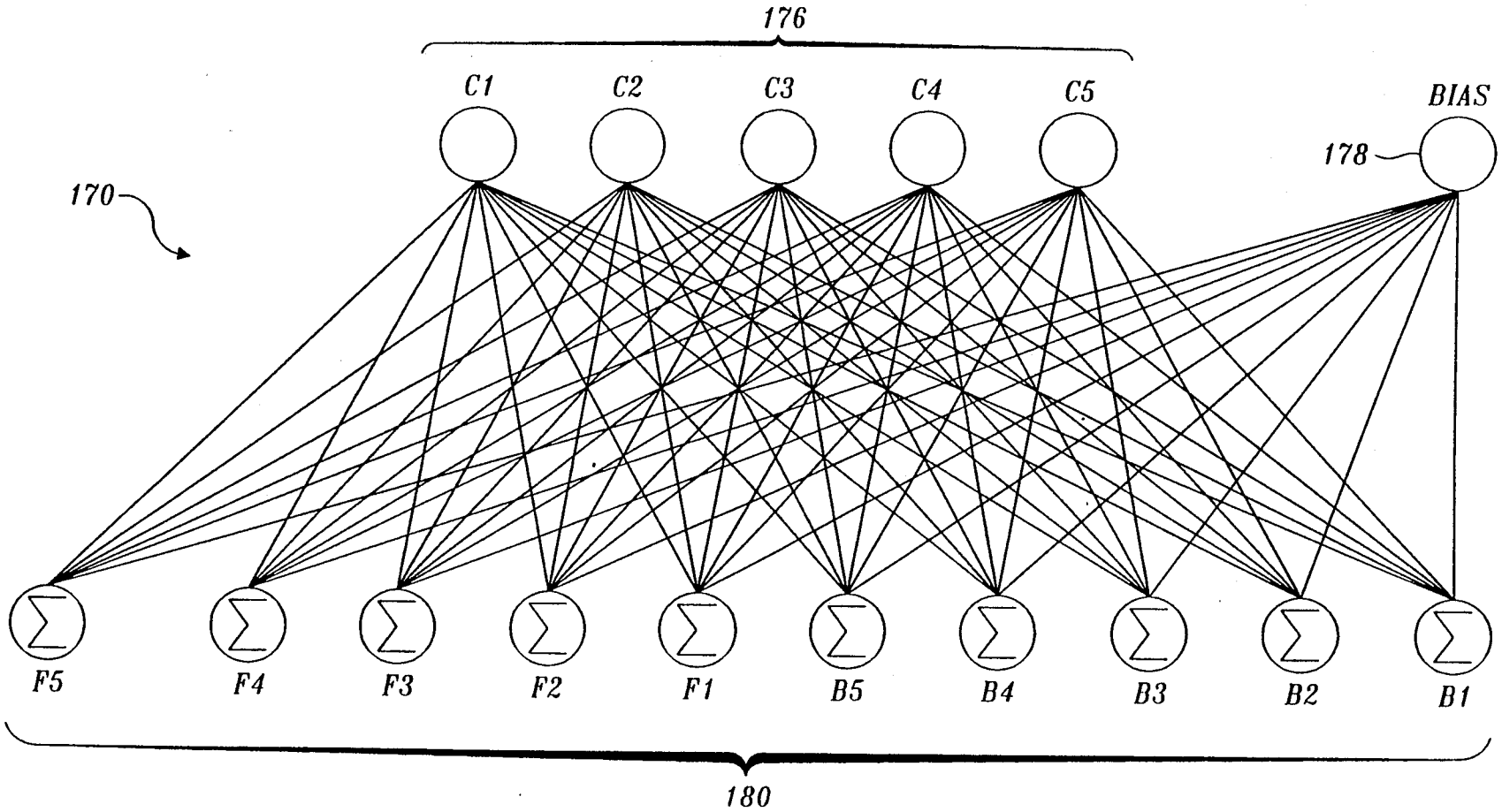
FIG. 7 graphically illustrates the mapping of speaker-independent cepstral coefficients and a bias value to formant and bandwidth that is implemented during synthesis of the speech.

After all segments of speech have been processed, a block 124 provides for deriving multiple regressive speaker-dependent mappings from the cepstral coefficients $C_i$ using the corresponding formants $F_i$ and bandwidths $B_i$. The mapping process is graphically illustrated in FIG. 7 generally at reference numeral 170, where five cepstral coefficients 176 and a bias value 178 are linearly combined to produce five formants and corresponding bandwidths 180 according to the following relationship:

$$e_i = a_{i0} + \sum_{j=1}^{N} a_{ij}C_{ij} \quad (14)$$

where $e_i$ are elements representing the respective formants and their bandwidths (i=1 through 10, corresponding to F1 through F5 and B1 through B5, in succession), $a_{i0}$ is the bias value, and $a_{ij}$ are weighting factors for the j-th cepstral coefficient and the i-th element (formant or bandwidth) that are applied to the cepstral coefficients $C_{ij}$. Mapping of the cepstral coefficients and bias value corresponds to a linear function that estimates the relationship between the formants (and their corresponding bandwidths) and the cepstral coefficients.

The linear regression analysis performed in this step is discussed in detail in *An Introduction to Linear Regression and Correlation*, by Allen L. Edwards (W. H. Freeman & Co., 1976), ch. 3. Thus, for each segment of speech, linear regression analysis is applied to map the cepstral coefficients 176 and bias value 178 into the formants and bandwidths 180. The mapping data resulting from this procedure are stored for subsequent use, or immediately used with speaker-independent cepstral coefficients to synthesize speech, as explained in greater detail below. A block 128 ends this first training portion of the procedure required for developing the speaker-dependent model for mapping of speaker-independent cepstral coefficients into corresponding formants and bandwidths.

Figure 4:
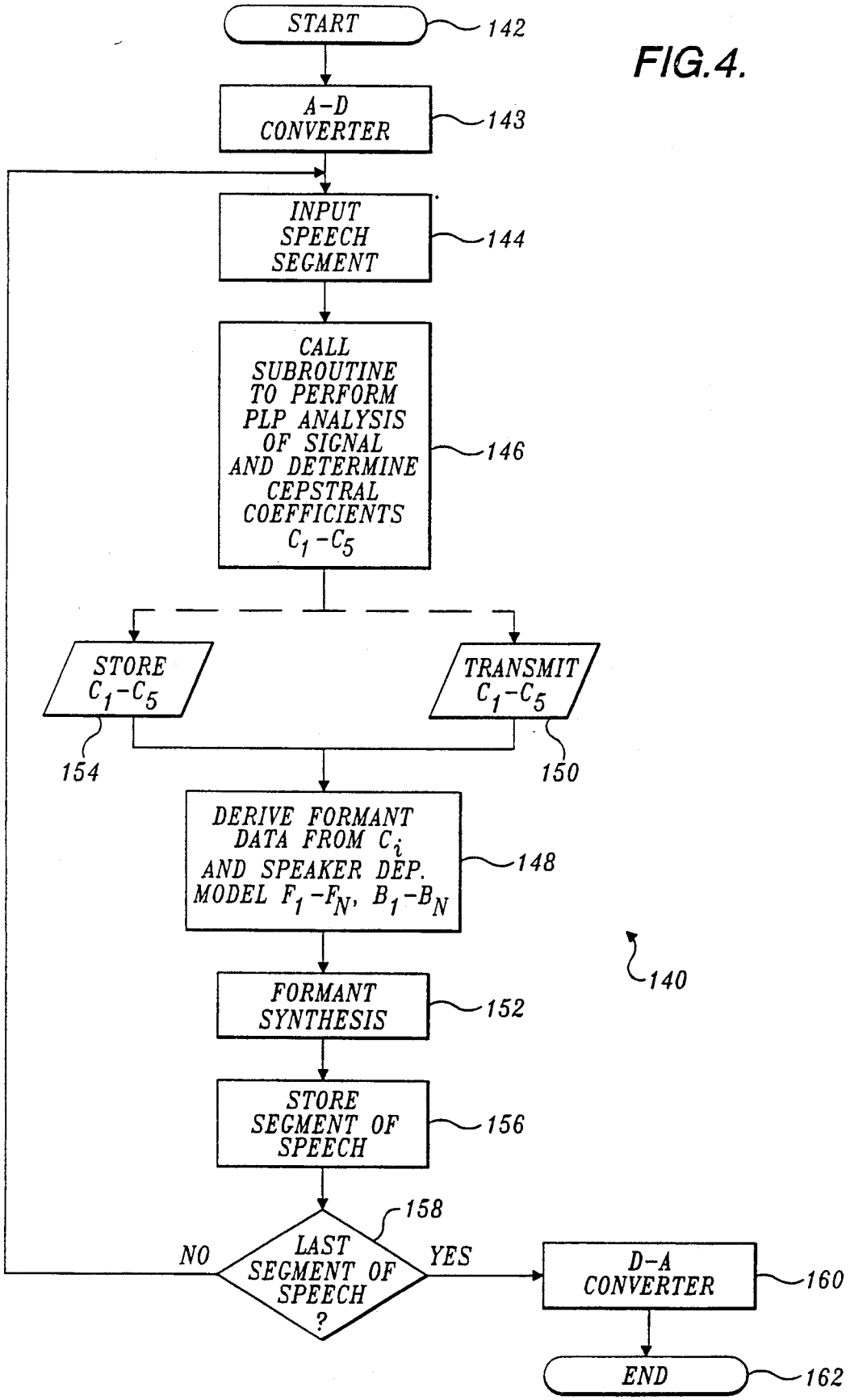
FIG. 4 is a flow chart illustrating the steps of synthesizing speech using the speaker-independent cepstral coefficients, in accordance with the present invention.

Turning now to FIG. 4, the speaker-dependent model defined by mapping data developed from the training procedure implemented by the steps of flow chart 50 can later be applied to speaker-independent data to synthesize vocalizations by that same speaker, as briefly noted above. Alternatively, the speaker-independent data (represented by cepstral coefficients) of one speaker can be modified by the model data of a different speaker to produce synthesized speech corresponding to the vocalization of the different speaker. Steps required for carrying out either of these scenarios are illustrated in a flow chart 140 in FIG. 4, starting at a block 142.

In a block 143, signals representing the analog speech of an individual (from block 22 in FIG. 2) are applied to an A-D converter, producing corresponding digital signals that are processed one segment at a time. Digital signals are input to CPU 36 in a block 144. A block 146 calls a subroutine to perform PLP analysis of the signal to determine the cepstral coefficients for the speech segment, as explained above with reference to flow chart 94 in FIG. 6. This subroutine returns the cepstral coefficients for each segment of speech, which are alternatively either stored for later use in a block 148, or transmitted, for example, by telephone line, to a remote location for use in synthesizing the speech represented by the speaker-independent cepstral coefficients. Transmission of the cepstral coefficients is provided in a block 150.

In a block 152, the speaker-dependent model represented by the mapping data previously developed during the training procedure is applied to the cepstral coefficients, which have been stored in block 148 or transmitted in block 150, to develop the formants $F_1$ through $F_n$ and corresponding bandwidths $B_1$ through $B_n$ needed to synthesize that segment of speech. As noted above, the linear combination of the cepstral coefficients to produce the formants and bandwidth data in block 152 is graphically illustrated in FIG. 7.

A block 154 uses the formants and bandwidths developed in block 152 to produce a corresponding synthesized segment of speech, and a block 156 stores the digitized segment of speech. A decision block 158 determines if the last segment of speech has been processed, and if not, returns to block 144 to input the next speech segment for PLP analysis. However, if the last segment of speech has been processed, a block 160 provides for digital-to-analog (D–A) conversion of the digital signals. Referring back to FIG. 2, block 160 produces the analog signal used to drive loudspeaker 44, producing an auditory response synthetically reproducing the speech of either the original speaker or speech sounding like another person, depending upon whether the original speaker's model (mapping data) or the other person's model is used in block 152 to map the cepstral coefficients into corresponding formants and bandwidths. A block 162 terminates flow chart 140 in FIG. 4.

Experiments have shown that there is a relatively high correlation between the estimated formants and bandwidths used to synthesize speech in the present invention and the formants and bandwidths determined by conventional LPC analysis of the original speech segment. Table 1, below, shows correlations between the true and model-predicted form of these parameters, the root mean square (RMS) error of the prediction, and the maximum prediction error. For comparison, values from the 10th order LPC formant estimation are shown in parentheses. The RMS error of the PLP-based formant frequency prediction is larger than the LPC estimation RMS error. LPC exhibits occasional gross errors in the estimation of lower formants, which show in larger values of the maximum LPC error. In fact, formant bandwidths are far better predicted by the PLP-based technique.

TABLE 1

FORMANT AND BANDWIDTH COMPARISONS

| PARAM. | F1 | F2 | F3 | F4 | F5 |
|---|---|---|---|---|---|
| CORR. | 0.94 (0.98) | 0.98 (0.99) | 0.91 (0.98) | 0.64 (0.98) | 0.86 (0.99) |
| RMS[Hz] | 23.6 (15.5) | 48.1 (37.0) | 48.2 (21.2) | 46.1 (12.6) | 52.4 (13.1) |
| MAX[Hz] | 131 (434) | 344 (2170) | 190 (1179) | 190 (610) | 220 (130) |
| | B1 | B2 | B3 | B4 | B5 |
| CORR. | 0.86 (0.05) | 0.92 (0.17) | 0.96 (0.43) | 0.64 (0.24) | 0.86 (0.33) |
| RMS[Hz] | 2.2 (45) | 1.6 (35) | 4.1 (37) | 4.1 (50) | 5.5 (52) |
| MAX[Hz] | 29.3 (3707) | 6.23 (205) | 32.0 (189) | 18.0 (119) | 22.0 (354) |

A significant advantage of the present technique for synthesizing speech is the ability to synthesize a different speaker's speech using the cepstral coefficients developed from low-order PLP analysis, which are generally speaker-independent. To evaluate the potential for voice modification, the vocal tract area functions for a male voicing three vowels /i/, /a/, and /u/ were modified by scaling down the length of the pharyngeal cavity by 2 cm and by linearly scaling each pharyngeal area by a constant. This constant was chosen for each vowel by a simple search so that the differences between the log of a male and a female-like PLP spectra are minimized. It has been observed that to achieve similar PLP spectra for both the longer and the shorter vocal tracts, the pharyngeal cavity for the female-like tracts need to be slightly expanded.

Figure 8A:
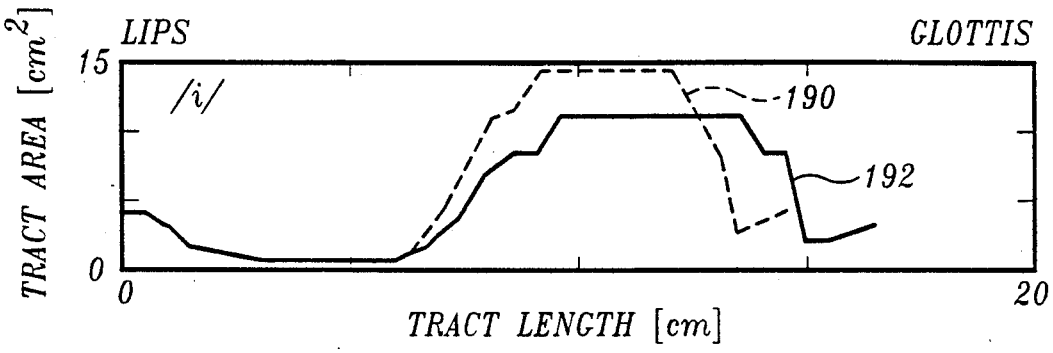
FIGS. 8A through 8C illustrate vocal tract area and length for a male speaker uttering three Russian vowels, compared to a simulated female speaker uttering the same vowels.
Figure 8B:
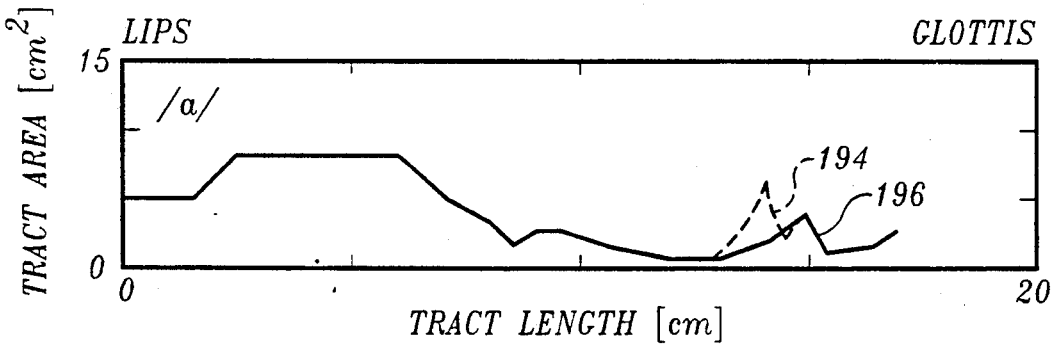
Figure 8C:
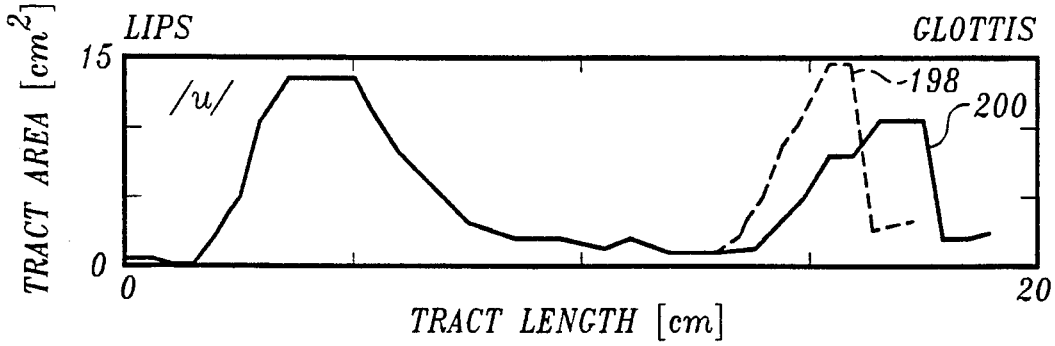

FIGS. 8A through 8C show the vocal tract functions for the three Russian vowels /i/, /a/, and /u/, using solid lines to represent the male vocal tract and dashed lines to represent the simulated female-like vocal tract. Thus, for example, solid lines 192, 196, and 200 represent the vocal tract configuration for a male, whereas dashed lines 190, 194, and 198 represent the simulated vocal tract voicing for a female.

Figure 9B:
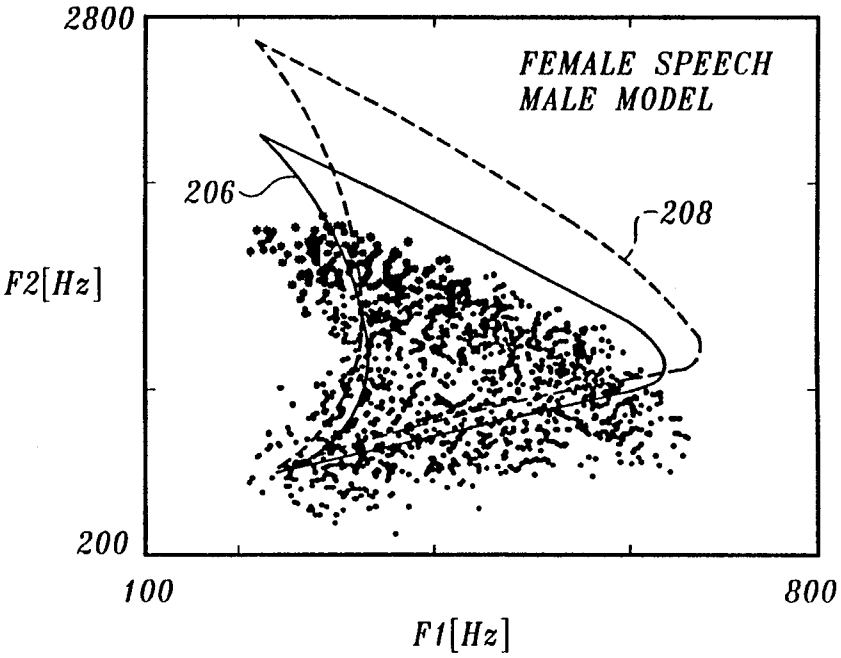
FIGS. 9A and 9B are graphs of the F1 and F2 formant vowel spaces for actual and modelled female and male speakers.
Figure 9A:
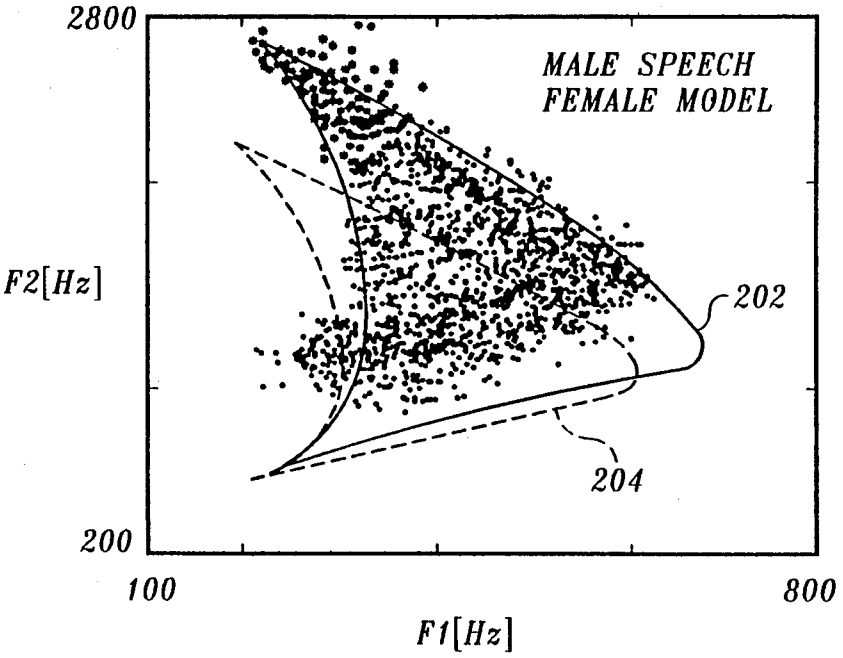

Both the original and modified vocal tract functions were used to generate vowel spaces. The training procedure described above was used to obtain speaker-dependent models, one for the male and one for the simulated female-like vowels. PLP vectors (cepstral coefficients) derived from male speech were used with a female-regressive model, yielding predicted formants, as shown in FIG. 9A. Similarly, PLP vectors derived from female speech were used with the male-regressive models to yield predicted formants depicted in FIG. 9B. In FIG. 9A, boundaries of the original male vowel space are indicated by a solid line 202, while boundaries of the original female space are indicated by a dashed line 204. Similarly, in FIG. 9B, boundaries of the original female vowel space are indicated by a solid line 206, and boundaries of the original male vowel space are indicated by a dashed line 208. Based on a comparison of the F1 and F2 formants for the original and the predicted models, both male and female, it is evident that the range of predicted formant frequencies is determined by the given regression model, rather than by the speech signals from which the PLP vectors are derived.

Further verification of the technique for synthesizing the speech of a particular speaker in accordance with the present invention was provided by the following experiment. The regression speaker-dependent model for a particular speaker was derived from four all-voiced sentences: "We all learn a yellow line roar;" "You are a yellow yo-yo;" "We are nine very young women;" and "Hello, how are you?" each uttered by a male speaker. The first five cepstral coefficients (log energy excluded) from the fifth order PLP analysis of the first utterance, "I owe you a yellow yo-yo," together with the regressive model derived from training with the four sentences were used in predicting formants of the test utterance, as shown in FIG. 10B.

Figure 10A:
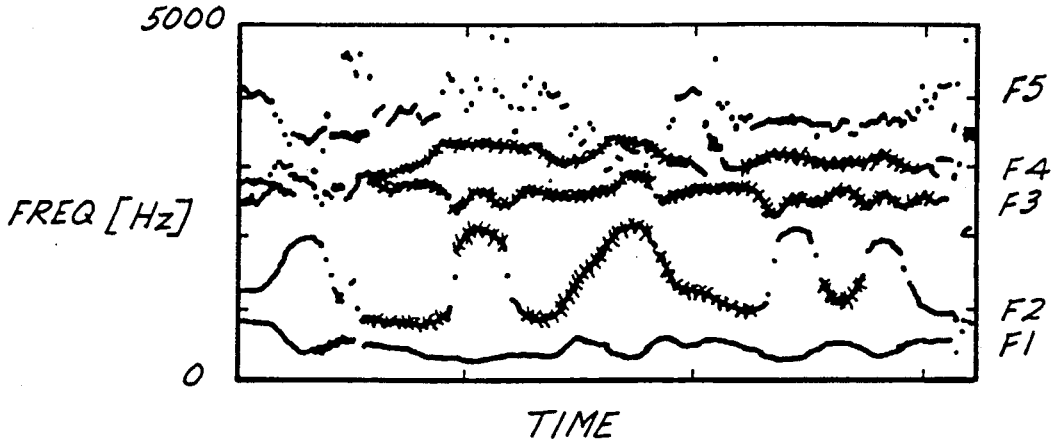
FIGS. 10A and 10B graphically illustrate the trajectories of complex pole predicted by LPC analysis of a sentence, and the predicted trajectories of formants derived from a male speaker-dependent model and the first five cepstral coefficients from the 5th order PLP analysis of that sentence, respectively.
Figure 10B:
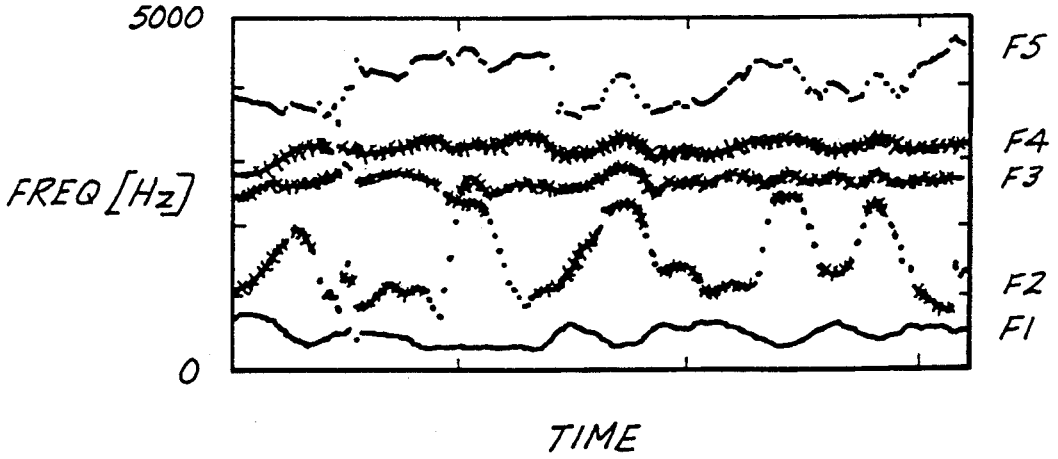

An estimated formant trajectory represented by poles of a 10th order LPC analysis for the same sentence, "I owe you a yellow yo-yo," uttered by a male speaker are shown in FIG. 10A. Comparing the predicted formant trajectories of FIG. 10B with the estimated formant trajectories represented by poles of the 10th order LPC analysis shown in FIG. 10A, it is clear that the first formant is predicted reasonably well. On the second formant trajectory, the largest difference is in /oh/ of "owe . . .," where the predicted second formant frequency is about 50% higher than the LPC estimated one. Furthermore, the predicted frequencies of the /j/s in "you" and "yo-yo," and of /e/ and /u/ in "yellow" are 15–20% lower than the LPC estimated ones. The predicated third order trajectory is again reasonably close to the LPC estimated trajectory. The LPC estimated fourth and fifth formants are generally unreliable, and comparing them to the predicted trajectories is of little value.

A similar experiment was done to determine whether synthetic speech can yield useful speaker-dependent models. In this case, speaker-dependent models derived from synthetic speech vowels were used, to produce a male regressive model for the same sentence. The trajectories of the formants predicted using the male regressive model in the first five cepstral coefficients from the fifth order PLP analysis of the sentence "I owe you a yellow yo-yo" uttered by a male speaker were then compared to the trajectories of formants predicted using the female regressive model (also derived from the synthetic vowel-like samples) in the first five cepstral coefficients from the fifth order PLP analysis of the same sentence, uttered by the male speaker.

Figure 11A:
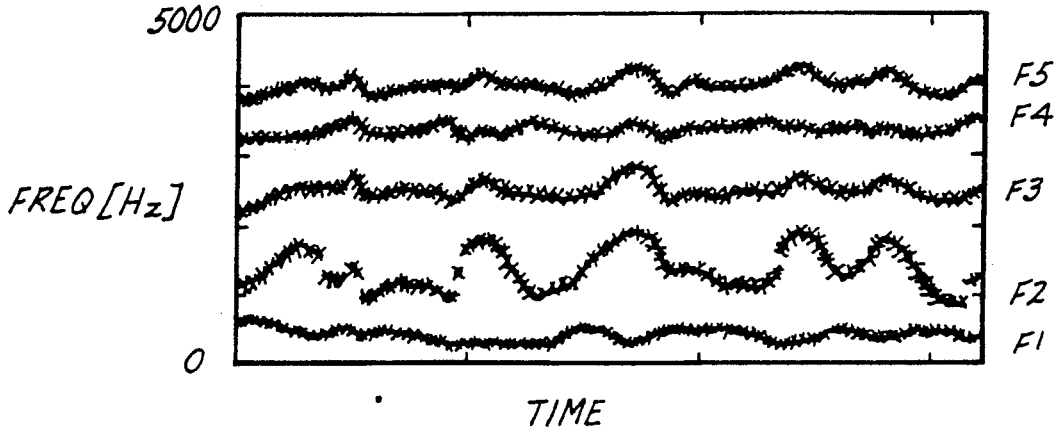
FIGS. 11A and 11B graphically illustrate the trajectories of formants predicted using a regressive model for a male and the first five cepstral coefficients from a sentence uttered by a male speaker, and the trajectories of formants predicted using a regressive model for a female and the first five cepstral coefficients from that same sentence uttered by a male speaker.
Figure 11B:
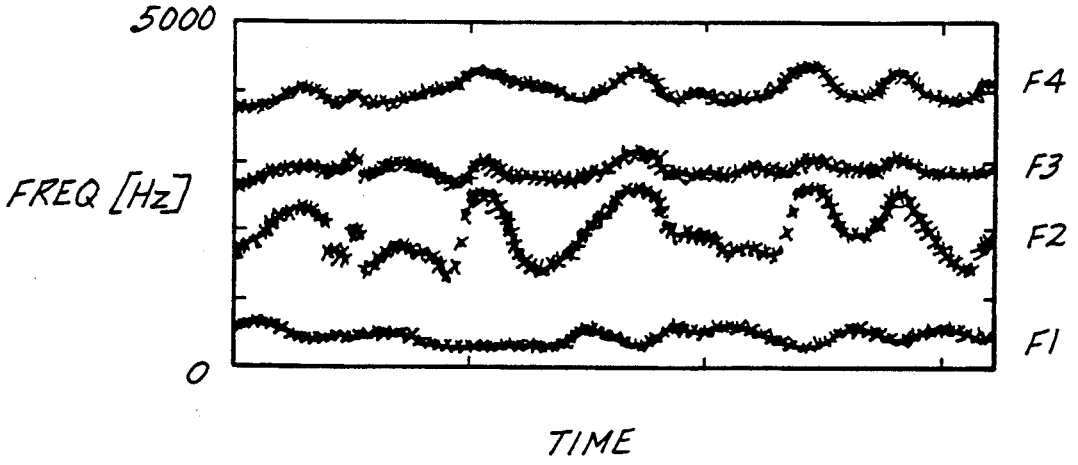

Within the 0 through 5 KHz frequency band of interest, the male regressive model yields five formants, while the female-like model yields only four. By comparison of FIGS. 11A and 11B, it is apparent that the formant trajectories for both genders are approximately the same. The frequency span of the female second formant trajectory is visibly larger than the frequency span of the male second formant trajectory, almost coinciding with the third male formants in extreme front semi-vowels, such as the /j/s in "yo-yo" and being rather close to the male second formants in the rounded /u/ of "you." The male third formant trajectory is very similar to the female third formant trajectory, except for approximately a 400 Hz constant downward frequency shift. However, the male fourth formant trajectory bears almost no similarity to any of the female formant trajectories. Finally, the fifth formant trajectory for the male is quite similar to the female fourth formant trajectory.

Although the preferred embodiment uses PLP analysis to determine a speaker-dependent model for a particular speaker during the training process and for producing the speaker-independent cepstral coefficients that are used with that or another speaker's model for speech synthesis, it should be apparent that other speech processing techniques might be used for this purpose. These and other modifications and changes that will be apparent to those of ordinary skill in this art fall within the scope of the claims that follow. While the preferred embodiment of the invention has been illustrated and described, it will be appreciated that such changes can be made therein without departing from the spirit and scope of the invention defined by these claims.

The embodiments of the invention in which an exclusive property or privilege is claimed are defined as follows:

1. A method for synthesizing human speech, comprising the steps of:

a. for a given human vocalization, determining a set of Perceptual Line Predictive (PLP) coefficients defining an auditory-like, speaker-independent spectrum of the vocalization;

b. mapping the set of PLP coefficients to a vector in a vocal tract resonant vector space, where the vector is defined by a plurality of vector elements; and c. using the vector in the vocal tract resonant space to produce a synthesized speech signal simulating the given human vocalization.

2. The method of claim 1, wherein fewer PLP coefficients are required in the set of coefficients than the plurality of vector elements that define the vector in the vocal tract resonant vector space.

3. The method of claim 2, wherein the set of coefficients is stored for later use in synthesizing speech.

4. The method of claim 2, wherein the set of coefficients comprises data that are transmitted to a remote location for use in synthesizing speech at the remote location.

5. The method of claim 1, further comprising the steps of determining speaker-dependent variables that define qualities of the given human vocalization specific to a particular speaker; and using the speaker-dependent variables in mapping the set of coefficients to produce the vector in the vocal tract resonant space, which is used in producing a simulation of that speaker uttering the given vocalizations.

6. The method of claim 5, wherein the speaker-dependent variables remain constant and are used with successive different human vocalizations to produce a simulation of the speaker uttering the successive different vocalizations.

7. The method of claim 1, wherein the set of coefficients represents a second formant, F2′, corresponding to a speaker's mouth cavity shape during production of the given vocalization.

8. The method of claim 1, wherein the step of mapping comprises the step of determining a weighting factor for each coefficient of the set so as to minimize a mean squared error of each element of the vector in the vocal tract resonant space.

9. The method of claim 8, wherein each element of the vector in the vocal tract resonant space is defined by:

$$e_i = a_{i0} + \sum_{j=1}^{N} a_{ij}c_{ij}$$

where $e_i$ is the i-th element, $a_{i0}$ is a constant portion of that element, $a_{ij}$ is the weighting factor associated with a j-th coefficient for the i-th element, $c_{ij}$ is the j-th coefficient for the i-th element; and N is the number of coefficients.

10. A method for synthesizing human speech, comprising the steps of:

a. repetitively sampling successive short segments of a human utterance so as to produce a unique frequency domain representation for each segment;

b. transforming the unique frequency domain representations into auditory-like, speaker-independent spectra, by representing a human psychophysical auditory response to the short segments of speech with the transformation;

c. defining each of the speaker-independent spectra using a limited set of Perceptual Line Predictive (PLP) coefficients for each segment;

d. mapping each limited set of PLP coefficients that define the speaker-independent spectra into one of a plurality of vectors in a vocal tract resonant vector space of a dimension greater than a cardinality of the limited set of PLP coefficients; and e. producing a synthesized speech signal from the plurality of vectors in the vocal tract resonant space, taken in succession, thereby simulating the human utterance.

11. The method of claim 10, wherein the transforming step comprises the steps of:

a. warping the frequency domain representations into their Bark frequencies;

b. convolving the Bark frequencies with a power spectrum of a simulated critical-band masking curve, producing critical band spectra;

c. pre-emphasizing the critical band spectra with a simulated equal-loudness function, producing pre-emphasized, equal loudness spectra; and d. compressing the pre-emphasized, equal loudness spectra with a cubic-root amplitude function, producing the auditory-like, speaker-independent spectra.

12. The method of claim 10, wherein the step of defining each of the auditory-like, speaker-independent spectra comprises the step of applying an inverse frequency transformation, using an all-pole model, wherein the limited set of coefficients comprise autoregression coefficients of the inverse frequency transformation.

13. The method of claim 10, wherein the limited set of coefficients that define each speaker-independent spectrum comprise cepstral coefficients of a perceptual linear prediction model.

14. The method of claim 10, wherein the vocal tract resonant vector space represents a linear predictive model.

15. The method of claim 10, further comprising the step of determining speaker-dependent variables that define qualities of a vocal tract in a speaker that produced the human utterance; and using the speaker-dependent variables in mapping each of the limited set of coefficients that define the speaker-independent spectra to produce the vectors in the vocal tract resonant space, thereby enabling simulation of the speaker producing the utterance.

16. The method of claim 15, wherein the speaker-dependent variables remain constant and are used to simulate additional different human utterances by that speaker.

17. The method of claim 16, the limited set of coefficients for each segment of the utterance and the speaker-dependent variables comprise data that are transmitted to a remote location for use in synthesizing the utterance at the remote location.

18. The method of claim 15, wherein the step of mapping comprises the step of determining a weighting factor for each coefficient so as to minimize a means squared error of each element of the vectors in the vocal tract resonant space.

19. The method of claim 10, wherein the coefficients represent a second formant, F2′, corresponding to a speaker's mouth cavity shape during the utterance of each segment.

20. The method of claim 10, wherein each element comprising the vectors in the vocal tract resonant space is defined by:

$$e_i = a_{i0} + \sum_{j=1}^{N} a_{ij} C_{ij}$$

where $e_i$ is the i-th element, $a_{i0}$ is a constant portion of that element, $a_{ij}$ is the weighting factor associated with a j-th coefficient for the i-th element, $c_{ij}$ is the j-th coefficient of the i-th element; and N is the number of coefficients.

* * * * *